US005713496A

United States Patent [19]

Ipsen

[11] Patent Number: 5,713,496

[45] Date of Patent: Feb. 3, 1998

[54] SEALING FOR A CONTAINER DEVICE

[75] Inventor: Bernt Ipsen, Morud, Denmark

[73] Assignee: Micro Matic A/S, Odense, Denmark

[21] Appl. No.: 571,987

[22] PCT Filed: Feb. 7, 1995

[86] PCT No.: PCT/DK95/00057

§ 371 Date: Jan. 3, 1996

§ 102(e) Date: Jan. 3, 1996

[87] PCT Pub. No.: WO95/21120

PCT Pub. Date: Aug. 10, 1995

[30] Foreign Application Priority Data

Feb. 7, 1994 [DK] Denmark ..... 0153/94

[51] Int. Cl.[6] ..... B65D 83/00

[52] U.S. Cl. ..... 222/400.7; 222/397; 222/542; 137/212

[58] Field of Search ..... 222/542, 400.7, 222/400.8, 397; 137/212

[56] References Cited

U.S. PATENT DOCUMENTS

| | | | |
|---|---|---|---|
| 3,353,724 | 11/1967 | Johnston et al. | 222/400.7 |
| 3,454,199 | 7/1969 | Malick | 222/400.7 |
| 3,473,556 | 10/1969 | Johnson et al. | 222/400.7 X |
| 3,497,114 | 2/1970 | Johnston . | |
| 3,861,569 | 1/1975 | Johnston | 222/400.7 |
| 3,908,861 | 9/1975 | Johnston | 222/400.7 X |
| 4,150,771 | 4/1979 | Golding | 222/400.7 |
| 4,181,143 | 1/1980 | Fallon | 222/400.7 X |
| 4,343,325 | 8/1982 | Fallon | 137/212 |
| 4,451,853 | 5/1984 | Dessenoix et al. | 137/212 |
| 4,715,414 | 12/1987 | Harrison et al. | 141/302 |

FOREIGN PATENT DOCUMENTS 0 263 620 4/1988 European Pat. Off. .

*Primary Examiner*—Kevin P. Shaver

*Attorney, Agent, or Firm*—Jacobson, Price, Holman & Stern, PLLC

[57] ABSTRACT

A sealing ring is placed in a container device which serves the purpose of distributing a liquid, e.g. draught beer, which is stored in a container under pressure of a gas, e.g. $CO_2$. In a threaded neck ring on the container a valve is threadingly retained. The valve is a combined gas- and liquid valve with passages for gas as well as liquid. On the valve and the neck ring planar, parallel, opposite ring faces are formed between which the sealing ring. From the ring face of the valve, a cylindrical projection protrudes and extends downwards to the ring face of the neck ring. Between the valve and the neck ring there is a slot space through which an overpressure in the container can be relieved when the valve is being dismounted. The projection serves the purpose of preventing this slot space from being closed for flow of gas by some of the sealing ring which is squeezed up into the space by the gas overpressure and preventing this space from being relieved, so that an operator, when dismounting a valve is exposed to the risk of being hit by the valve, if this, by the gas overpressure, is being thrown out into the room in the very moment when the valve releases its engagement with the neck ring.

10 Claims, 4 Drawing Sheets

SEALING FOR A CONTAINER DEVICE

FIELD OF THE INVENTION

The invention relates to a sealing for a container device of the type serving the purpose of distributing a liquid, e.g. draught beer, and comprising a container, which under pressure of a gas, e.g. $CO_2$, stores the liquid, and also a combined gas- and liquid valve being mounted in a neck ring which is fixed on the container and sealed in relation to this by means of a sealing ring which is placed between opposite ring faces on the valve and on the neck ring, respectively.

BACKGROUND OF THE INVENTION

Such a container device is normally cleaned, filled and discharged with the valve mounted. On the consumption place a coupling head is fixed to the valve which through activation of the coupling head opens for passages between the inner part of the container and a gas source and a drawing off place, respectively for e.g. serving of draught beer.

After use, when the container is empty, the coupling head is dismounted whereafter the gas- and liquid passages of the valve automatically are closed. In a container device, which usually is emptied for liquids, there will normally therefore remain a certain overpressure.

This overpressure may be of danger to an operator who is going to dismount a valve when replacing this latter, or when inspecting the inside of the container. If the valve is dismounted while it is loaded by the overpressure, there might be a risk that it, without specific security precautions, is shot out into the room with great force when it loosens the catching with the neck ring. If it hits the operator in this process he might be seriously injured.

In order to avoid accidents of this kind, the valve constructions therefore to-day are often supplied with security arrangement meant to provide for the fact that the overpressure is relieved before the valve's engagement with the neck ring is released.

However, it has shown that the normally square sealing ring between the valve and the neck ring in conventional sealing constructions is liable to be deformed by the gas pressure in such a way that some of the sealing ring penetrates into the slot space which is formed between the valve and the neck ring for passage of the gas during dismounting of the valve.

Thereby the slot space is being closed so that the gas will not be able to escape this way, as intended, and in spite of said security precautions the unsuspecting operator, who relies on the liability of the security arrangement, might nevertheless risk to be hit by a valve which, when being dismounted, is shot out into the room by the overpressure not being relieved after all.

It is therefore required to provide a sealing ring of the type mentioned in the opening paragraph where the sealing ring will not be deformed in such a way that some of the ring can penetrate into and close the slot space which exists between the valve and the neck ring for relieving the gas pressure during dismounting of the valve.

SUMMARY OF THE INVENTION

The novel and unique features according to the invention, whereby this is achieved, is the fact that the valve has a ring-formed projection which protrudes from the periphery of the ring face of the valve with direction towards the ring face of the neck ring. This projection blocks the radial deformation of the ring face and prevents the overpressure in the container from pressing some of the ring into the slot space between the valve and the neck ring. Thereby the gas is always secured a free passage through the slot space when the valve is being dismounted, and the valve is therefore guaranteed to be free from pressure lead when the engagement of the valve with the neck ring is released.

Normally, the opposite ring faces of the valve and the neck ring, respectively, are planar and parallel. In these cases it will be an advantage if the projection has a length which is adequate lesser than the thickness of the mounted and possibly squeezed sealing ring. The length must, however, be large enough to be able to control the radial deformation of the ring to such an extent, that nothing of the ring can penetrate into the slot space between the valve and the neck ring and close the passage of the gas into the open air.

By a particulary advantageous embodiment the sealing ring can have a square cross section and the projection a cylindrical inner side fitting to the outer side of the sealing ring, whereby at least that part of the sealing ring, which adjoins the projection is safely fixed against radial expansion.

When the inner side of the projection is conical with convergence toward the ring face, the placing of the sealing ring to the valve is facilitated, and the side of the sealing ring, which is next to the ring face of the neck ring, is permitted to have a radial expansion which increases the sealing effect in relation to the neck ring, while the opposite side of the sealing ring simultaneously is blocked against being radially deformed.

If the free inwards turning edge of the projection is rounded off the material of the sealing ring is spared from over loading and its lifetime is prolonged.

BRIEF DESCRIPTION OF THE DRAWINGS

The invention will be explained more fully by the following description of an embodiment, which just serves as an example, with reference to the drawing, in which.

DETAILED DESCRIPTION OF THE PREFERRED EMBODIMENTS

Figure 1:
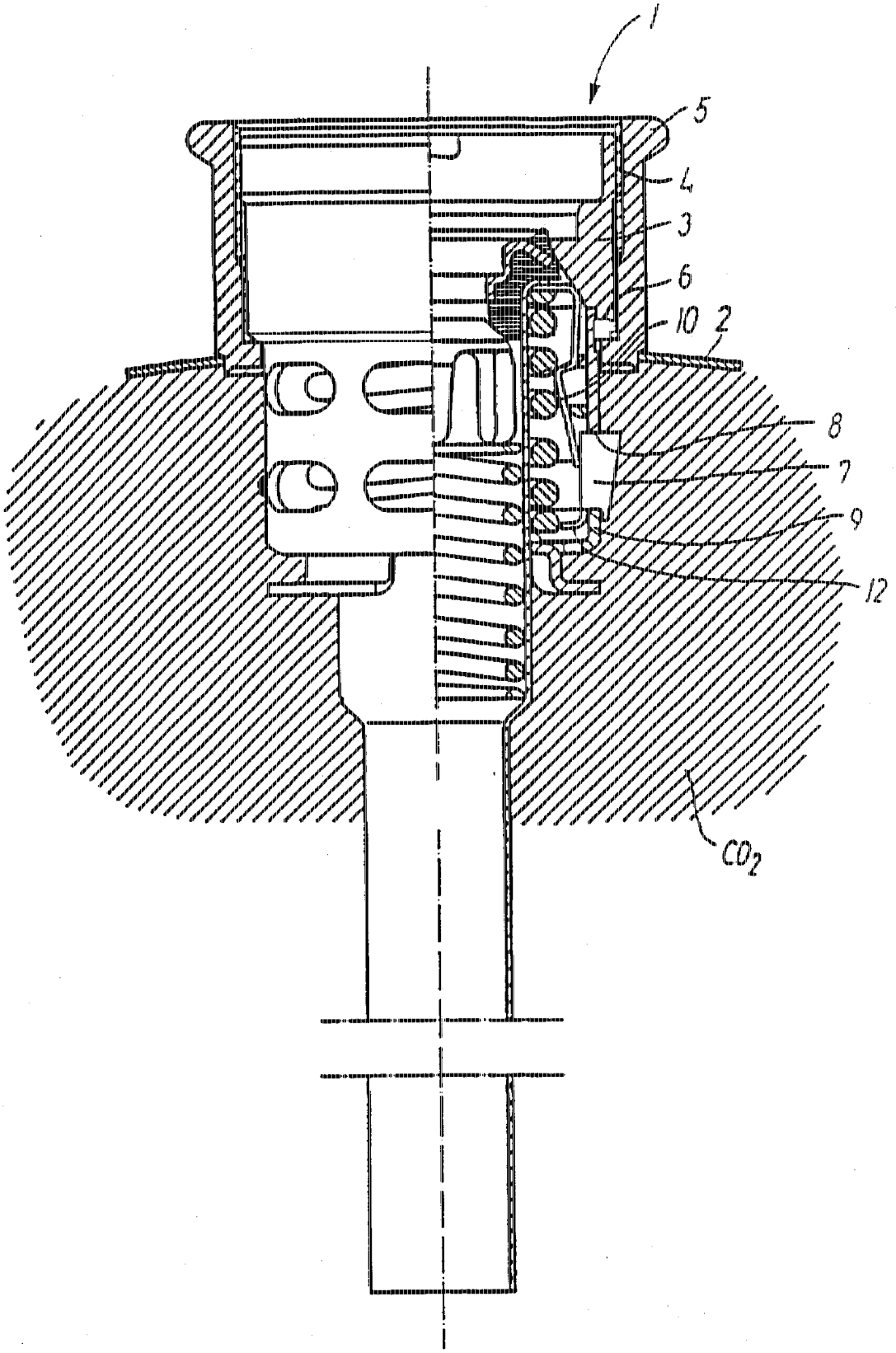
FIG. 1 shows a combined gas- and liquid valve, which is mounted in a neck ring on a container, which only can be seen in section.
Figure 2:
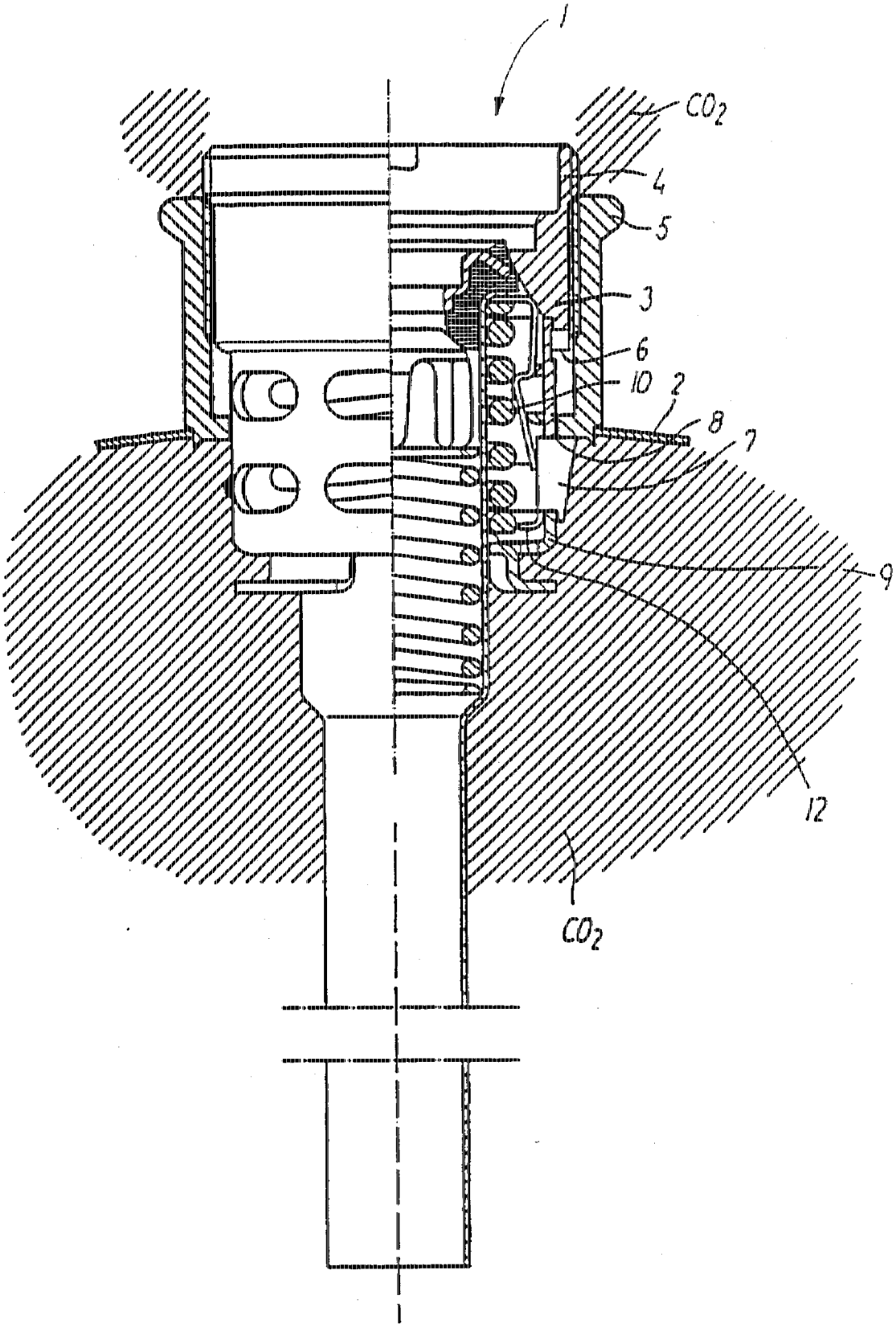
FIG. 2 shows the same, but where the valve is being dismounted and shown in the position where the valve's engagement with the neck ring just has been released.

FIGS. 1 and 2 shows a container device, which is generally designated by the reference numeral 1. The device comprises a container 2 and a combined gas- and liquid valve 3. The container can e.g. be used for draught beer which is to be kept under pressure by the gas $CO_2$, as implied with hatching.

The valve 3 is per se of a well-known type and will therefore not be described further here. In FIG. 1 the valve is, by means of a thread 4, screwed into a neck ring 5, which is mounted on the container 2. The valve 3 and the neck ring 5 are sealed in relation to each other with a sealing ring 6, which in this case has a square cross section and is placed between the opposite, plane and parallel ring faces 14;15 on the valve and the neck ring, respectively.

The valve shown in FIGS. 1 and 2 has a tilting catch 7 which can tilt into and out of an opening 8 in the valve house 9. The tilting catch is retained in the shown outwards tilted position by a resilient finger 10 as is located in the valve 3. Thereby it is prevented that the $CO_2$ overpressure in the container throws the valve out into the room when the valve is screwed off the thread of the neck ring by dismounting, in that the valve then will be stopped by the outwards tilted tilting catch, when this, as shown in FIG. 2, is abutting the under side of the neck ring.

Before the valve subsequently can be removed from the neck ring, the tilting catch 7 must be tilted into the opening 8, so that the valve 3 now unobstructed can be removed from the neck ring 5. This part of the dismounting takes place by means of a special tool (not shown) which pushes the finger 10 so far downwards that it will be pressed against an inwards turning flap 12 on the tilting catch 7 which thereby is tilted into the opening 8 and free of the neck ring 5.

While the operator in this way is manipulating the valve in order to screw it free from the neck ring and tilt the tilting catch into the opening 8, the gas overpressure in the container is blown off via a slot space 11 between the valve and the neck ring. When the valve finally releases the engagement with the thread of the neck it will therefore be without load and can be removed without any risk.

Figure 6:
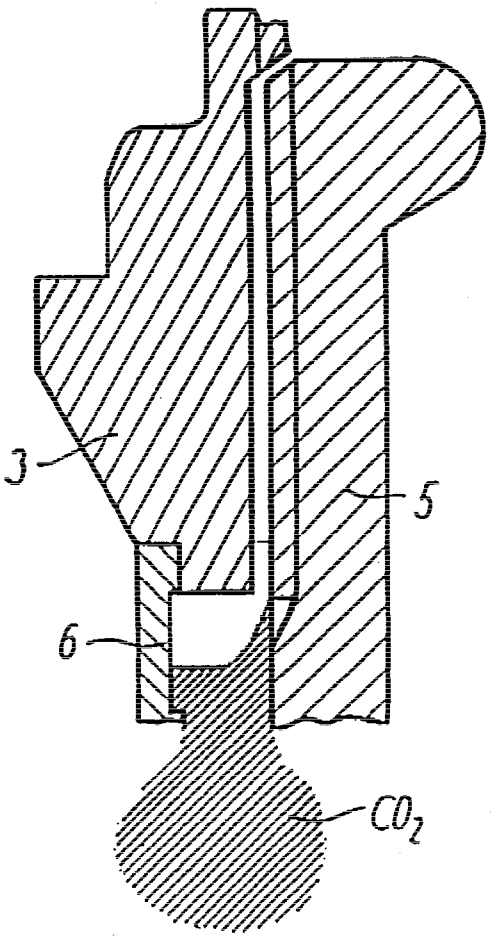
FIG. 6 shows the same, but during dismounting.
Figure 5:
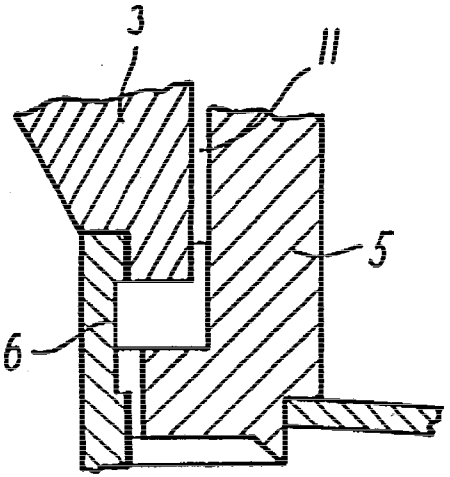
FIG. 5 shows on an enlarged scale a section of a conventional sealing between a valve and a neck ring.

In spite of the existence of this fact or similar security arrangement, there is, however, a risk that the conventional sealing security arrangement, as shown in FIGS. 5 and 6, can fail due to the fact that part of the sealing ring is pressed into the slot space 11 by the gas overpressure in the container. Thereby this slot space is blocked for the passage of gas and the overpressure in the container is remaining. This situation is utmost dangerous because the operator relies on the fact that the security arrangement of the valve is a full guarantee for that dismounting of the valve is possible without any risk for himself to be hurt. He will therefore not be on guard to the possibility that the security arrangement nevertheless is set out of function and he can therefore unintended cause a serious accident when he is dismounting the valve.

Figure 4:
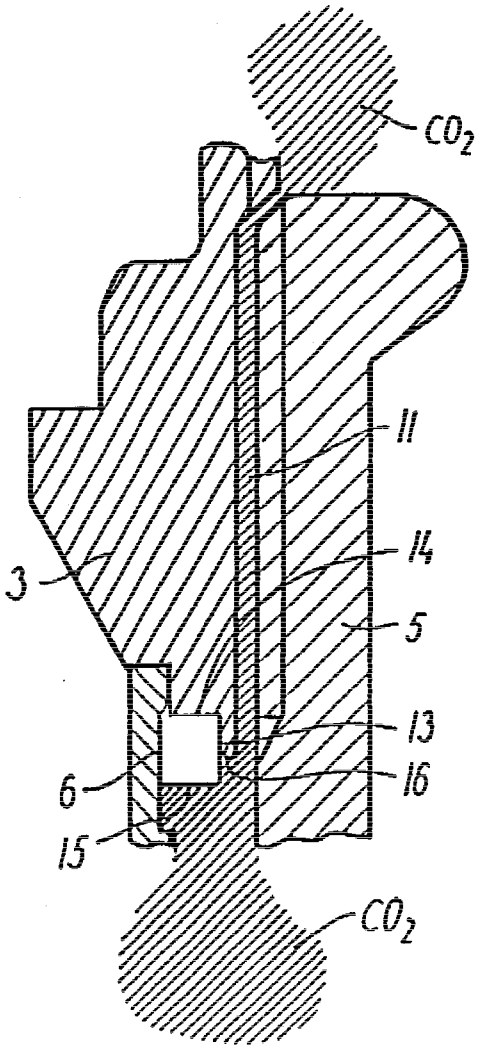
FIG. 4 shows the same, but during dismounting.
Figure 3:
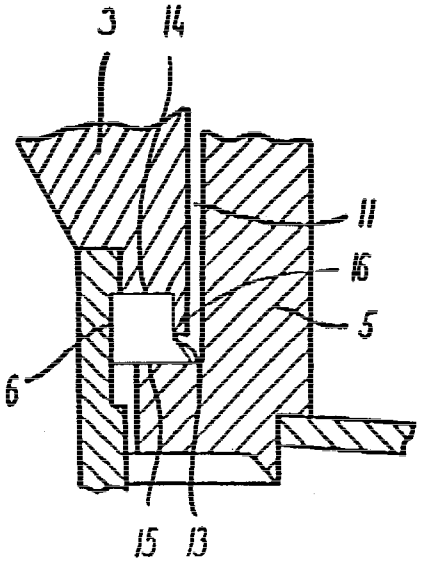
FIG. 3 shows on an enlarged scale the sealing between the valve and the neck ring as shown in FIG. 1.
Figure 7:
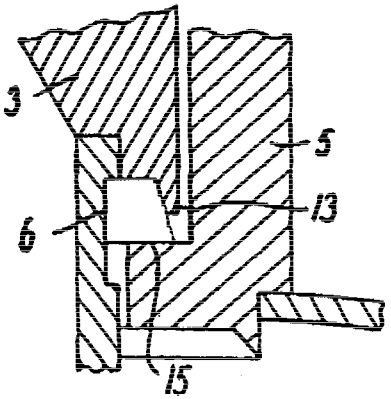
FIG. 7 shows an alternate embodiment, on an enlarged scale, of the sealing between the valve and the neck ring as shown in FIG. 3.

This risk is eliminated by the construction according to the invention, where there, as shown in FIGS. 3, 4 and 7, is formed a ring formed projection 13 on the valve 3.

The projection is extending somewhat downwards along the outer side of the sealing ring, thereby preventing the former uncontrolled deformation of the sealing ring into the radial direction. The sealing ring can now no longer penetrate into the slot space 11 and close for the passage of the gas from the container into the open air, and the valve can be removed without danger for the operating personnel.

As mentioned before, the sealing ring 6 is placed between the two plane ring faces 14;15 on the valve and on the neck ring, respectively. In order to avoid that the projection will abut the ring face 15 of the neck ring, the projection has a length which is lesser than the thickness of the sealing ring even in squeezed condition between the two ring faces.

The ring-formed projection is to prevent the sealing ring from being radially deformed along its upper side while its under side very well can be deformed radially. An advantageous balancing between these two extremities takes place when the projection has a length of between 20% and 80%, preferably between 30% and 70% and especially between 40% and 60% of the thickness of the sealing ring in mounted state.

In order to prevent the projection from cutting into the outer side of the sealing ring during the deformation of this latter, and thereby damage the material of the ring, the inwardly turning edge 16 of the projection can furthermore be rounded off.

When the inner side of the projection is cylindrical as shown in FIGS. 3 and 4, an adequate fitting is obtained between ring and projection in the full extension of the latter. By forming the inner side conical with convergence towards the ring face of the valve as shown in FIG. 7, the mounting of the sealing ring to the valve is facilitated and at the same time the transition from the radially undeformed upper side of the ring to the deformed under side will be smoother whereby the elastic material of the ring is protected from being locally overloaded.

I claim:

1. A sealing device for use in distributing a liquid from a container having a neck ring fixed on the container with the liquid in the container being under pressure by a gas, said sealing device comprising:

a combined gas and liquid valve for mounting in the neck ring and sealed in relation to the neck ring by a sealing ring placed between opposite ring faces on the valve and on the neck ring, respectively, for use in a security device formed by a slot arranged between the valve and the neck ring for relieving overpressure in the container when demounting the valve, the valve having a ring-formed projection protruding at the slot from an outer periphery of the ring face of the valve in a direction towards the ring face of the neck ring to partially engage the sealing ring and prevent the sealing ring from blocking the slot.

2. A sealing device according to claim 1, wherein the projection has a length smaller than a thickness of the sealing ring in a mounted state between the ring faces.

3. A sealing device according to claim 1, wherein the projection has a cylindrical inner side.

4. A sealing device according to claim 1, wherein an inner side of the projection is conical, converging towards the ring face of the valve.

5. A sealing device according to claim 1, wherein an inner turning free edge of the projection is rounded off.

6. A sealing device according to claim 1, wherein the sealing ring has a square cross section.

7. A sealing device according to claim 1, wherein the valve threadingly engages the neck ring.

8. A sealing device according to claim 1, wherein the projection has a length of between 20% and 80% of a thickness of the sealing ring in a mounted state between the ring faces.

9. A sealing device according to claim 8, wherein the projection has the length of between 30% and 70% of the thickness of the sealing ring in the mounted state.

10. A sealing device according to claim 9, wherein the projection has the length of between 40% and 60% of the thickness of the sealing ring in the mounted state.

* * * * *